United States Patent [19]

Wu

[11] 4,333,645

[45] Jun. 8, 1982

[54] EXERCISING APPARATUS WITH GAS RESISTANCE

[75] Inventor: Hann C. Wu, Tainan, Taiwan

[73] Assignee: Horng Meei Spring Enterprise Co. Ltd., Tainan, Taiwan

[21] Appl. No.: 193,797

[22] Filed: Oct. 3, 1980

[30] Foreign Application Priority Data

Dec. 14, 1979 [TW] Taiwan ..... 6824956
Jun. 2, 1980 [GB] United Kingdom ..... 8017920

[51] Int. Cl.[3] ..... A63B 21/00
[52] U.S. Cl. ..... 272/130; 272/DIG. 5
[58] Field of Search ..... 272/130, 137, 141, 143, 272/DIG. 5, DIG. 4, 72, 76, 116, 131; 16/49

[56] References Cited

U.S. PATENT DOCUMENTS

| | | | |
|---|---|---|---|
| 1,831,255 | 11/1931 | Menzies | 273/80 B |
| 3,268,225 | 8/1966 | Kölbel | 272/137 |
| 3,746,339 | 7/1973 | Cox | 272/137 |
| 3,834,696 | 9/1974 | Spector | 272/130 |
| 3,944,221 | 3/1976 | Berkestad et al. | 272/130 |
| 3,955,655 | 3/1976 | Pornin | 272/130 X |
| 4,148,479 | 4/1979 | Spector | 272/130 |

FOREIGN PATENT DOCUMENTS

| | | | |
|---|---|---|---|
| 7810374 | 4/1980 | Netherlands | 272/130 |

*Primary Examiner*—Richard C. Pinkham
*Assistant Examiner*—William R. Browne
*Attorney, Agent, or Firm*—Salter & Michaelson

[57] ABSTRACT

An exercising device having a cylinder having a handle fixed to one end, a piston movable in the cylinder and carried at one end of a piston rod extending through a gas-tight seal in the end wall of the cylinder opposite the handle, and a further handle fixed to the other end of the piston rod. The cylinder contains a pressurized gas and the piston has a narrow bore through which the gas can pass during compression and expansion of the device. Since the effective area of the piston on the side opposite the piston rod is greater than that on the other side, the high pressure gas produces a net resilient force on the piston tending to expand the device. The passage of gas through the bore in the piston provides a damping effect which must be overcome when the device is compressed and which slows the expansion of the device when the handles are released.

3 Claims, 4 Drawing Figures

EXERCISING APPARATUS WITH GAS RESISTANCE

This invention relates to exercising apparatus.

More particularly, the invention relates to exercising devices of the kind comprising an elongate member having a handle at each end and being compressible so that the handles can be moved towards one another against a resisting force. Such exercising devices are known in which the elongate member consists of two telescoping tubes containing a spring or a gas such as air providing a resilient force against which the handles can be moved together by the user and which returns the handles to their original position when the user releases them. A disadvantage of such devices is that if the handles are suddenly released the resilient force can return them very rapidly to the original position with consequent risk of harm to the user. There are also known exercising devices of the kind referred to in which one of the handles is fixed to a cylinder containing oil and the other handle is fixed to a piston rod carrying a piston movable in the cylinder, the piston having a hole through which the oil can pass so that the oil provides a uniform resistance to movement of the piston as the handles are moved together or pulled apart. A disadvantage of such devices in that the handles do not return to their original position when they are released.

This invention consists in an exercising device comprising a cylinder having a handle fixed to one end, a piston movable in the cylinder and carried at one end of a piston rod extending through a gas-tight seal in the end wall of the cylinder opposite the handle, a further handle being fixed to the other end of the piston rod, the cylinder containing a pressurised gas and the piston having a bore through which the gas can pass during compression and expansion of the device.

Since the effective area of the piston on the side opposite the piston rod is greater than that on the other side, the high pressure gas produces a net resilient force on the piston tending to expand the device. The passage of gas through the bore in the piston provides a damping effect which must be overcome when the device is compressed and which slows the expansion of the device when the handles are released.

A pressurized gas such as nitogen is introduced into the cylinder during assembly of the device.

Figure 1:
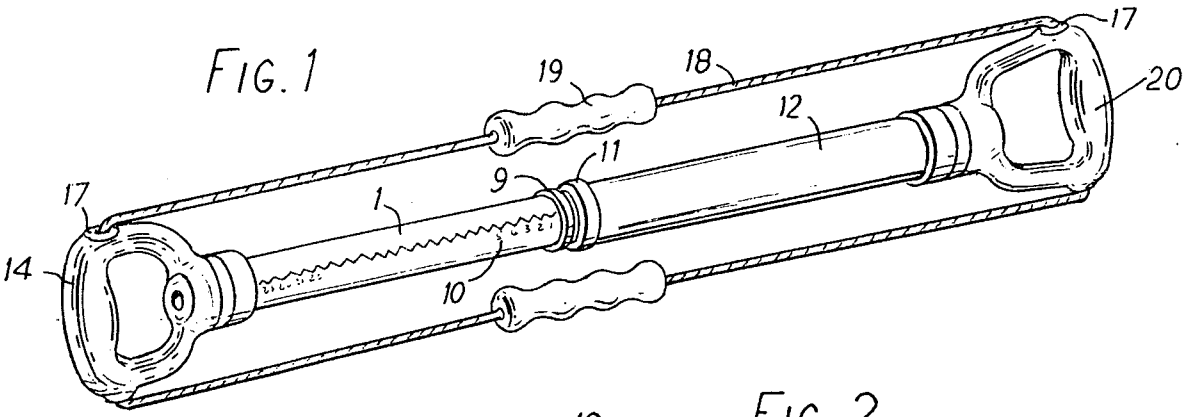
Figure 2:
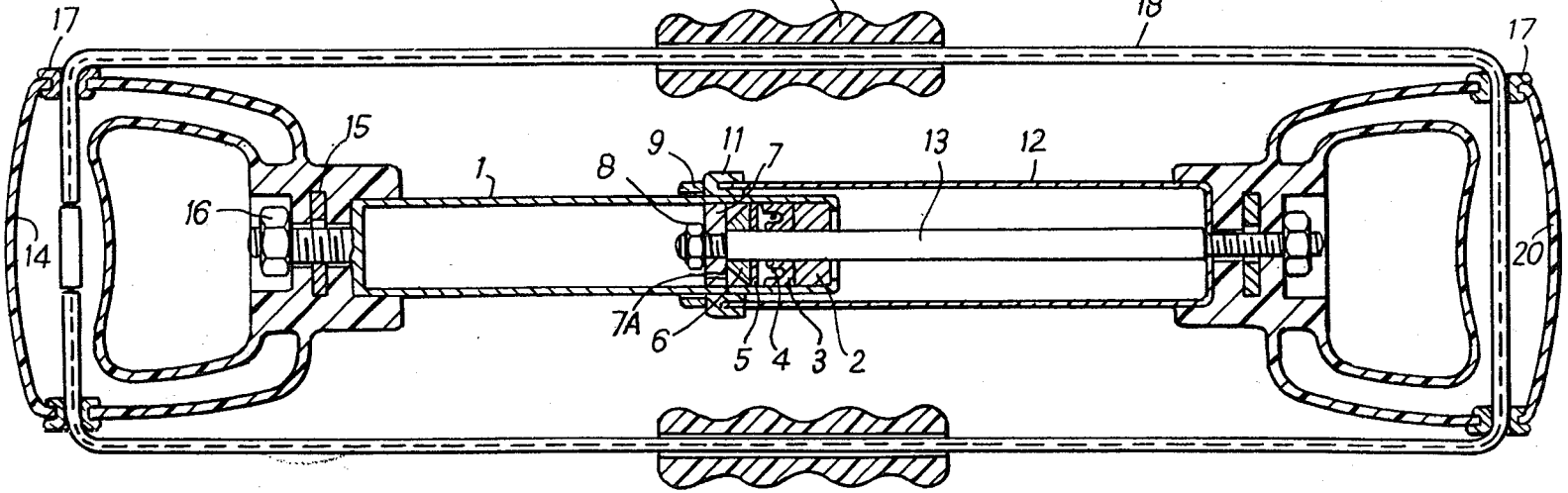
Figure 3:
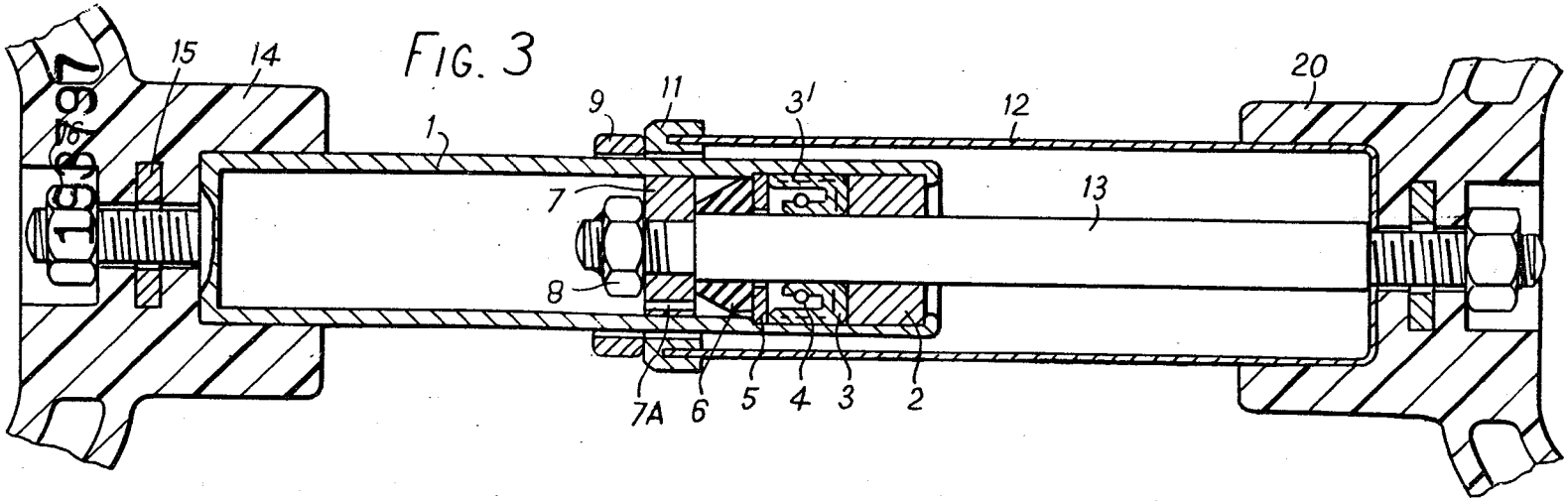
Figure 4:
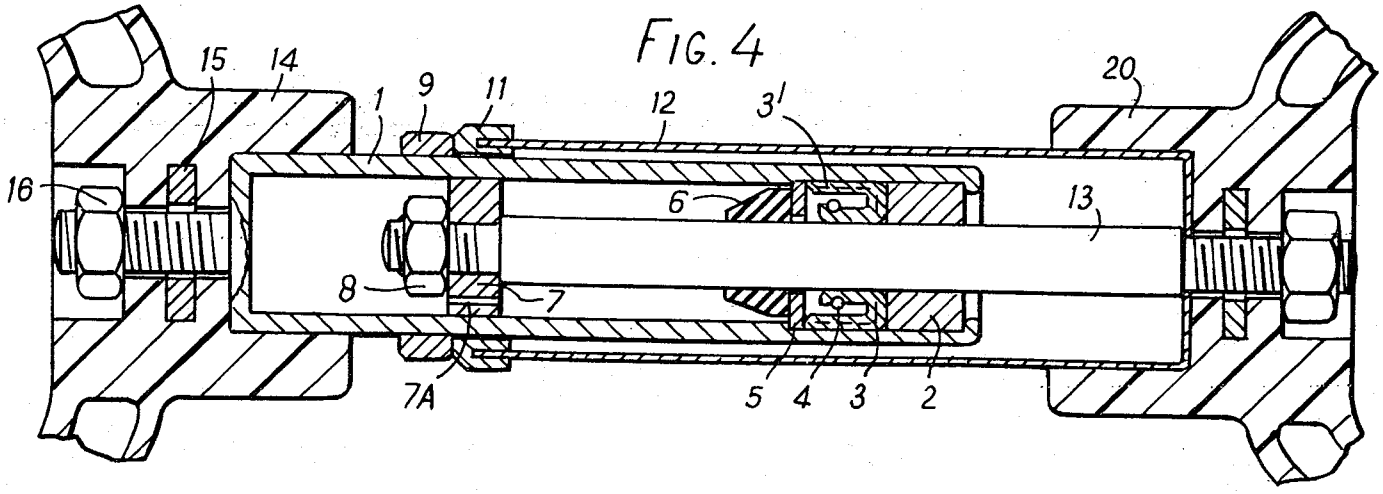

The invention will now be described, by way of example, with reference to the accompanying drawings, in which:

FIG. 1 is a perspective view of an exercising device in accordance with the invention, FIG. 2 is a cross-section through the device, FIG. 3 is a view similar to FIG. 2, showing part of the device on a larger scale, and FIG. 4 is a view similar to FIG. 3, showing the device in the compressed state.

Referring to the drawings, the device comprises a cylinder 1 of steel closed at one end. A handle 14 of plastics is secured to the closed end of cylinder 1 by means of a nut 16 engaging a bolt 161 welded to the cylinderl. A steel reinforcing plate 15 is embedded in handle 14. The other end of the cylinder 1 is closed by a block 2 formed with a bore through which slides a piston rod 13.

The piston rod 13 is fixed to the outer end wall of an outer tube 12 which fits telescopically over the cylinder 1. A plastics spacer 11 is fixed to the inner end of the outer tube 12 and slides on the outer surface of cylinder 1. A handle 20, similar to the handle 14, is secured to the outer end of tube 12, by means of a nut 201 engaging a screw-threaded portion 201 of the piston rod 13.

A piston 7, which is slidable within the cylinder 1, is fixed to the end of the piston rod 13 by means if a nut 8. The end of cylinder 1 through which the piston rod 13 passes is sealed in a gas-tight manner by means of a sealing ring 3 which engages the inner surface of cylinder 1 and which has an inner lip forced into contact with the piston rod 13 by an annular spring 4. The sealing ring 3 is held in position and protected from damage by a metal ring 5 fitted into a stepped recess in the inner surface of cylinder 1.

A body 6 of elastomeric material surrounds the piston rod 13 between the ring 5 and the piston 7 to act as a shock absorber and assist in protecting the seal 3 from damage when the piston reaches the ring 5 on expansion of the device.

The cylinder 1 is filled a gas or gases under high pressure, after assembly of the device. The piston 7 is perforated with a small diameter bore 7A through which the gas passes as the piston moves in the cylinder 1, the diameter of the bore determining the damping effect and therefore the force required to move the piston at any particular speed. Since the piston rod 13 extends on only one side of the piston 7 the effective area of the piston on the side opposite the piston rod is greater than that on the other side. The pressure of the gas in the cylinder therefore produces a net force on the piston tending to move it to the right as seen in FIGS. 2 to 4, even when the pressure on the two sides of the piston is equalised by the passage of gas through the bore 7A in the piston.

Connecting the handles 14 and 20 is a plastic-covered steel rope 18, which passes through each handle, the ends of the rope being joined together by a compression joint 21 inside handle 14, so that two lengths of the rope extend between the handles, one on each side of the cylinder 1 and tube 12. The rope 18 enters and leaves each handle through an eye 17. A plastic grip 19 is slidable on each length of the rope.

The cylinder 1 bears on its outer face a scale 10, and a plastics indicated ring 9 is slidable on the cylinder 1, so that when the handles are moved together the ring 9 is moved by the outer tube 12 along the scale 10 and remains in the position it has reached when the handles are released to allow the device to expand, to indicate the degree of compression achieved.

In assembly of the device during manufacture, the piston 7, after being secured to piston rod 13 with the shock absorber 6 in position, is inserted into cylinder 1 and then the appropriate pressure of gas is placed in the cylinder. The protective ring 5 and sealing ring 3 are then placed in position, and the block 2 closing the end of the cylinder is inserted and secured in place.

In operation of the device, the handles 14 and 20 can be gripped by the user and pushed together to compress the device. The force needed to do so has to overcome both the resilient force tending to move the piston to the right, and damping effect of the gas passing through the bore 7A. The resilient force increases as the handles are moved together, since the increasing proportion of the piston rod 13 moving into the cylinder 1 decreases the net volume of the cylinder, so compressing further the gas and increasing its pressure. When the handles are released the resilient force moves the piston back to its rest position, as shown in FIGS. 2 and 3. The damping effect of gas moving through the bore 7A ensures that this movement is relatively slow, so that there is no risk of damage to the user by rapid movement of the handles to the rest position.

In stead of grasping the handles 14 and 20, the user can hold the grips 19 on rope 18 and pull them apart, so that the device is compressed. The device can thus be used for exercises requiring a pulling force.

I claim:

1. An exercising device comprising a cylinder having a handle fixed to one end, a piston movable in the cylinder and carried at one end of a piston rod extending through a gas-tight seal in the end wall of the cylinder opposite the handle, a further handle fixed to the other end of the piston rod, the cylinder containing a pressurized gas and the piston having a bore through which the gas can pass during compression and expansion of the device, the cylinder being permanently closed in the rotion of the cylinder opposite the gas-tight seal through which the piston rod extends so that the volume of the pressurized gas in the cylinder is decreased as the piston rod is moved further into the cylinder when an external force is applied to the handles to compress the device, the effective area of the face of the piston facing the opposite portion being larger than the effective area of the opposite face of the piston, thus the pressurized gas exerts a net force on the piston and tends to return the piston toward the rest or start position.

2. An exercising device as claimed in claim 1, in which the pressurized gas is nitrogen.

3. An exercising device as claimed in claim 1 or claim 2, in which there is provided an outer tube surrounding and movable with the piston rod, the outer tube fitting telescopically over the cylinder.

* * * * *